US009142880B2

(12) United States Patent
Zhang et al.

(10) Patent No.: US 9,142,880 B2
(45) Date of Patent: Sep. 22, 2015

(54) ANTENNA MODULE AND ELECTRONIC SYSTEM

(71) Applicant: DELTA ELECTRONICS, INC., Taoyuan Hsien (TW)

(72) Inventors: Jie Zhang, Taoyuan Hsien (TW); Bing-Wen Weng, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 211 days.

(21) Appl. No.: 13/970,138

(22) Filed: Aug. 19, 2013

(65) Prior Publication Data

US 2014/0361933 A1 Dec. 11, 2014

(30) Foreign Application Priority Data

Jun. 7, 2013 (CN) ..... 2013 1 0225882

(51) Int. Cl.
*H01Q 1/24* (2006.01)
*H01Q 1/42* (2006.01)

(52) U.S. Cl.
CPC ..... *H01Q 1/243* (2013.01)

(58) Field of Classification Search
CPC ..... H01Q 1/243
See application file for complete search history.

(56) References Cited

U.S. PATENT DOCUMENTS

| | | | | |
|---|---|---|---|---|
| 5,757,327 | A * | 5/1998 | Yajima et al. | 343/713 |
| 7,580,002 | B2 * | 8/2009 | Noro | 343/872 |
| 2013/0050035 | A1 * | 2/2013 | Kato et al. | 343/741 |
| 2013/0169489 | A1 * | 7/2013 | Tamura | 343/702 |

* cited by examiner

*Primary Examiner* — Trinh Dinh
(74) *Attorney, Agent, or Firm* — CKC & Partners Co., Ltd.

(57) ABSTRACT

The disclosure discloses an antenna module and an electronic system. The antenna module includes a waterproof protective cover, a transparent cap, a printed circuit board, a wireless communication unit and an antenna unit. The waterproof protective cover is removably assembled onto an opening on a metal shielding case of the electronic system. The waterproof protective cover has a housing slot. The transparent cap is mounted on the waterproof protective cover. A first part of the printed circuit board is inserted into the housing slot. A second part of the printed circuit is located within the metal shielding case. The wireless communication unit is disposed on the second part of the printed circuit board. The antenna unit is disposed on the first part of the printed circuit board and electrically connected with the wireless communication unit.

12 Claims, 5 Drawing Sheets

ANTENNA MODULE AND ELECTRONIC SYSTEM

RELATED APPLICATIONS

This application claims priority to China Application Serial Number 201310225882.7, filed Jun. 7, 2013, which is herein incorporated by reference.

BACKGROUND

1. Technical Field

The present disclosure relates to an antenna. More particularly, the present disclosure relates to a modularized antenna suitable for a power system.

2. Description of Related Art

Power systems (e.g., power plants, power generators, solar panels, etc) require controlling circuits for maintaining their functions or monitoring their conditions. There are many ways to implement the controlling circuits, such as implementing programmable logic controllers (PLC) on each individual device, setting up a central controller to control multiple devices, or implementing a wireless controller for controlling all devices remotely. Among these solutions, the wireless controller provides the best flexibility and controllability.

The wireless controller requires an antenna for transferring or receiving the telecommunication signals or information between two devices. Some traditional antennas are sealed within the metal casing of the device. Some other antennas are formed as individual pieces extending from a printed circuit board of the device to an external space outside the device. The traditional antenna design is suitable for an indoor device. However, the same design of antenna encounters some problem while being utilized in an outdoor device, such as a micro-inverter or an electronic device with requirements of ingress protection (IP).

For example, the micro-inverter is one of common electrical device with requirements of ingress protection (IP) and is widely used in a distributed power network. Many devices in the distributed power network are implemented outdoors. Therefore, the micro-inverter usually has a metal shielding case for providing an ingress protection. For example, some micro-inverters are required to have a high ingress protection rating, e.g. rating at IP65. If the antenna is sealed inside the metal shielding case, the telecommunication signal will be blocked by the metal shielding case. On the other hand, if the antenna is extended through a through hole on the metal shielding case, it is hard to achieve the waterproof requirement for the ingress protection rating.

In addition, some electronic devices with requirements of ingress protection (IP) may require extra holes opened on the metal shielding case in order to display indicative light signals representing the working state of the electronic devices. However, extra holes on the case may increase the difficulty of waterproof feature.

SUMMARY

To solve the problems in the art, the disclosure provides an antenna module and an electronic system, which include a waterproof protective cover, which is removably assembled on an opening of the metal shielding case of the electronic system. An antenna unit is disposed in a housing slot within the waterproof protective cover. The antenna unit can be covered by the waterproof protective cover and also located outside the metal shielding case, such that signal strength of the antenna unit may not be reduced by the metal shielding case. The waterproof protective cover can be locked on the metal shielding case to achieve the waterproof feature. In addition, the antenna module includes a transparent cap mounted on the waterproof protective cover, such that the indicative light may go through the transparent cap without violating the waterproof feature.

An aspect of the disclosure is to provide an antenna module suitable for an electronic system. The electronic system includes a metal shielding case. The antenna module includes a waterproof protective cover, a transparent cap, a printed circuit board, a wireless communication unit and an antenna unit. The waterproof protective cover is removably assembled on an opening of the metal shielding case. The water-proof protective cover has a housing slot. The transparent cap is mounted on the waterproof protective cover. A first part of the printed circuit board is inserted into the housing slot. A second part of the printed circuit is located within the metal shielding case. The wireless communication unit is disposed on the second part of the printed circuit board. The antenna unit is disposed on the first part of the printed circuit board and electrically connected with the wireless communication unit.

Another aspect of the disclosure is to provide an electronic system, which includes a metal shielding case, a mainboard, an electronic circuit, an antenna module. The mainboard is disposed within the metal shielding case. The electronic circuit is disposed on the mainboard. A part of the antenna module being exposed outside the metal shielding case. The antenna module includes a waterproof protective cover, a transparent cap, a printed circuit board, a wireless communication unit and an antenna unit. The waterproof protective cover is removably assembled on an opening of the metal shielding case. The water-proof protective cover has a housing slot. The transparent cap is mounted on the waterproof protective cover. A first part of the printed circuit board is inserted into the housing slot. A second part of the printed circuit is located within the metal shielding case. The wireless communication unit is disposed on the second part of the printed circuit board. The wireless communication unit is electrically connected to the mainboard of the electronic system. The antenna unit is disposed on the first part of the printed circuit board and electrically connected with the wireless communication unit. The antenna unit is located outside a shielding space formed by the metal shielding case.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present disclosure. One skilled in the relevant art will recognize, however, that the present disclosure can be practiced without one or more of the specific details, or in combination with or with other components, etc. In other instances, well-known implementations or operations are not shown or described in detail to avoid obscuring aspects of various embodiments of the present disclosure.

Figure 1:
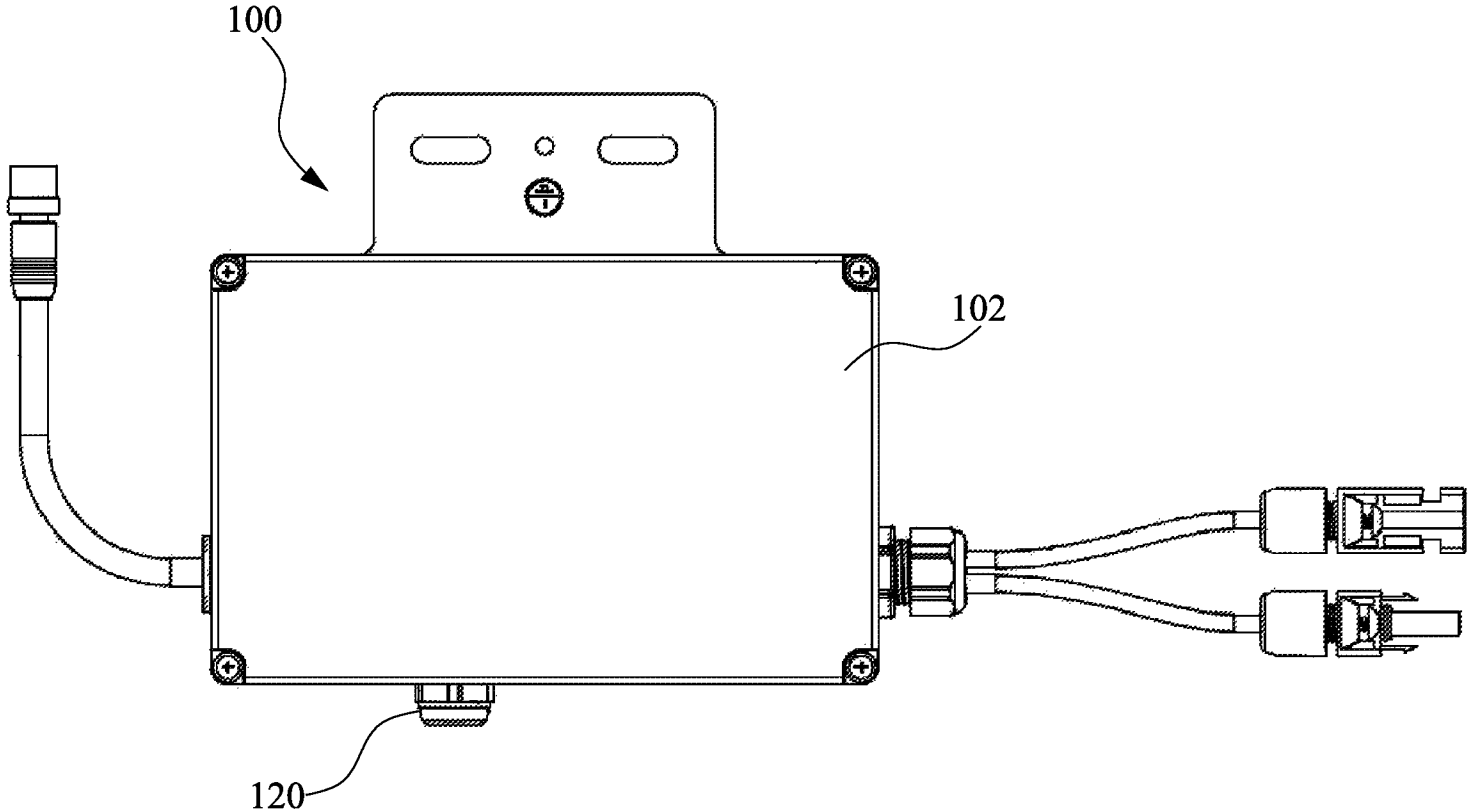
FIG. 1 is a top view diagram illustrating an electronic system 100 according to an embodiment of the disclosure.

Reference is made to FIG. 1, which is a top view diagram illustrating an electronic system 100 according to an embodiment of the disclosure. As shown in FIG. 1, the electronic system 100 includes a metal shielding case 102 and an antenna module 120. The metal shielding case 102 forms a sealing space for accommodating some electronic components (e.g., inverter circuits, capacitors, resistors, chips, or other electronic components) of the electronic system 100. The metal shielding case 102 is configured to be waterproof and dustproof for protecting these internal components. For example, the electronic system 100 can be a micro-inverter system.

The antenna module 120 is installed on an opening (not shown in FIG. 1) on the metal shielding case 102. As shown in FIG. 1, a part of the antenna module 120 is exposed outside the metal shielding case 102.

Figure 2:
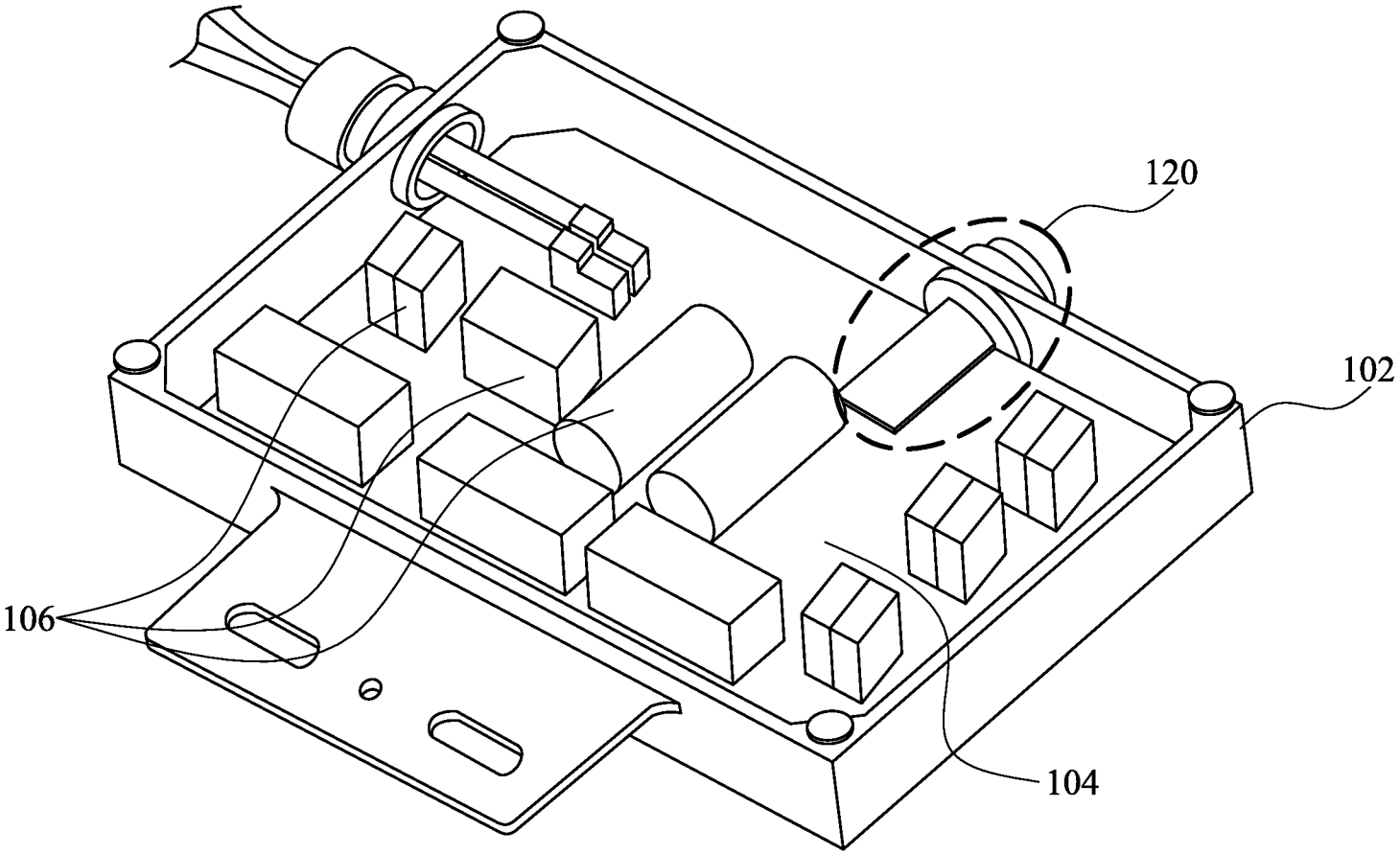
FIG. 2 is a perspective view diagram illustrating the electronic system in FIG. 1 form a different visual angle.
Figure 3:
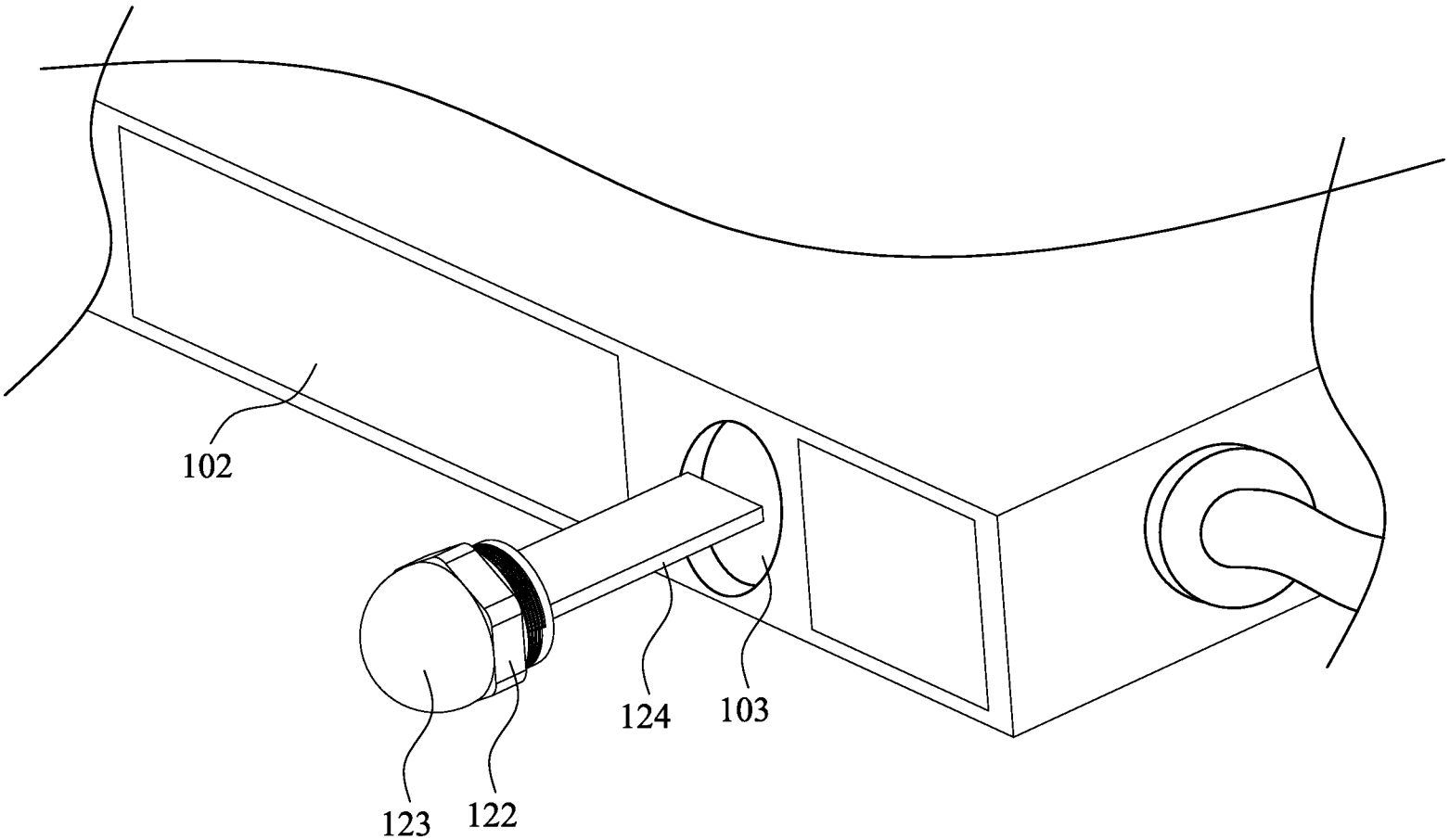
FIG. 3 is a schematic diagram illustrating the antenna module, the metal shielding case and the opening on the metal shielding case.

Reference is also made to FIG. 2 and FIG. 3. FIG. 2 is a perspective view diagram illustrating the electronic system 100 in FIG. 1 form a different visual angle. FIG. 3 is a schematic diagram illustrating the antenna module 120, the metal shielding case 102 and the opening 103 on the metal shielding case 102 in this embodiment.

As shown in FIG. 2, the electronic system 100 further includes a mainboard 104 and some electronic components (e.g., an inverter, a transformer, a capacitor, a reticular, etc) for forming an electronic circuit 106. The electronic circuit 106 is disposed on the mainboard 104. The mainboard 104 and the electronic circuit 106 are covered by the metal shielding case 102 and protected from water or dust. Therefore, the electronic system 100 can be installed outdoors.

As shown in FIG. 3, there is an opening 103 formed on the metal shielding case 102. The antenna module 120 is installed on the opening 103, such that one part of the antenna module 120 extends inside the shielding case 102 and the other part of the antenna module 120 is exposed outside the metal shielding case 102.

Figure 4:
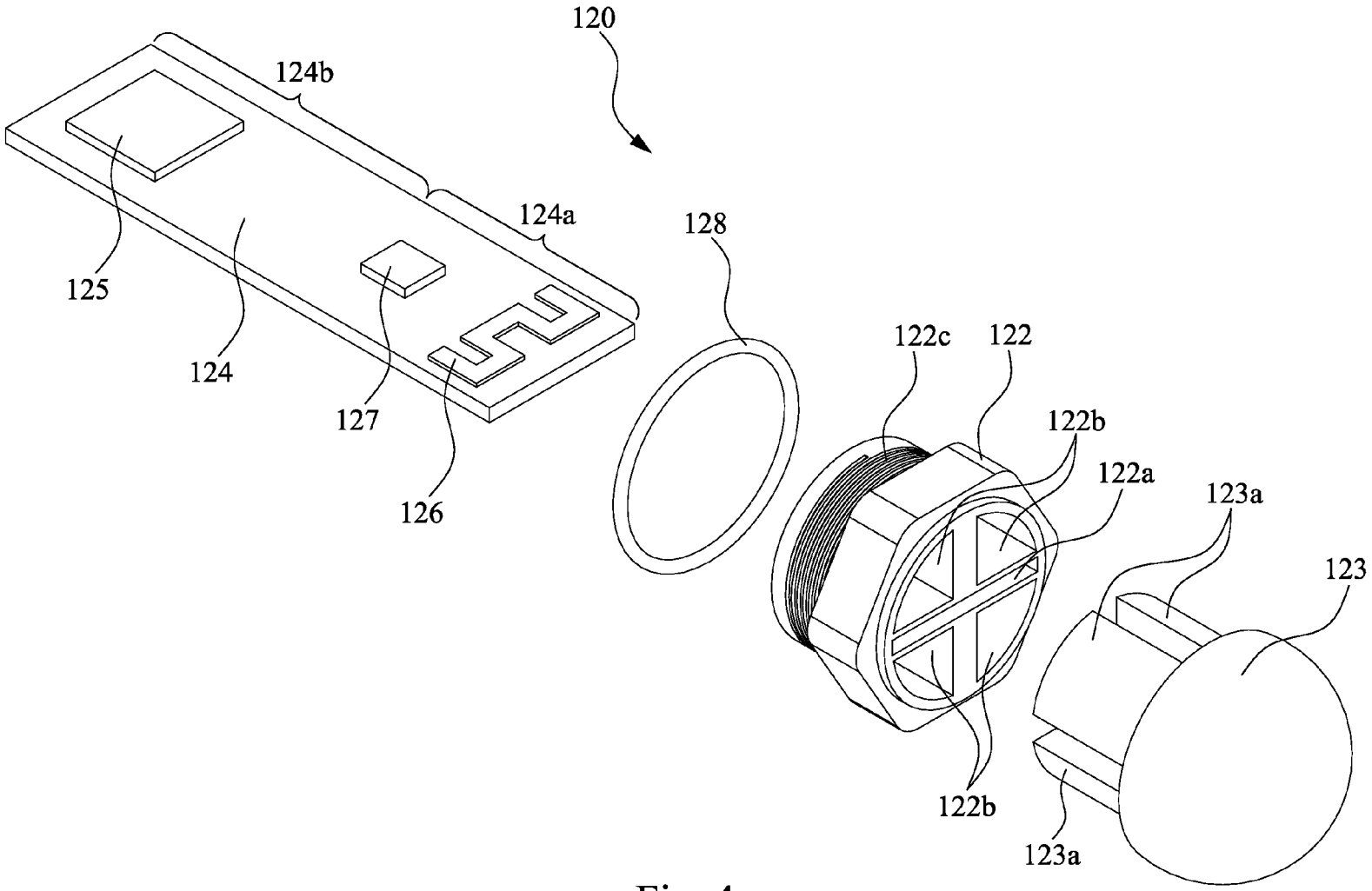
FIG. 4 is an exploded view diagram illustrating the antenna module according to an embodiment of the disclosure.
Figure 5:
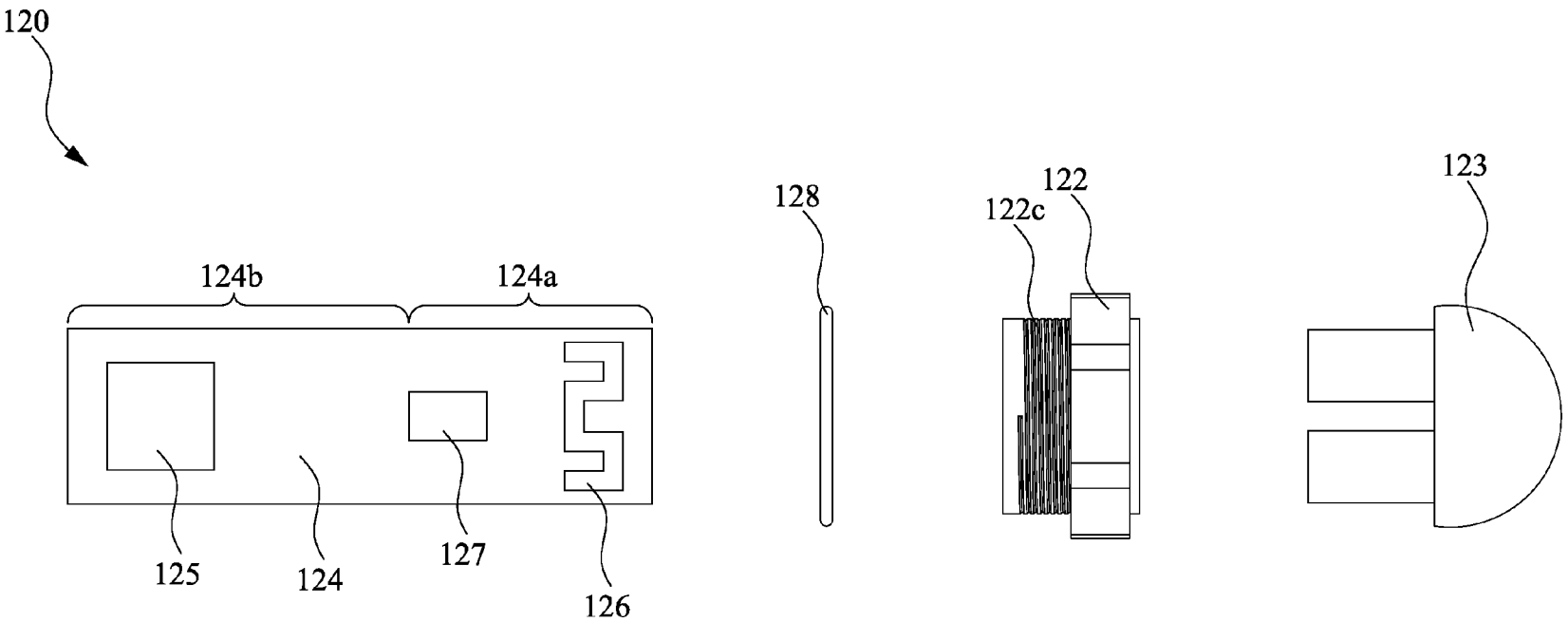
FIG. 5 is a schematic diagram illustrating the antenna module in FIG. 4.

Reference is also made to FIG. 4 and FIG. 5. FIG. 4 is an exploded view diagram illustrating the antenna module 120 according to an embodiment of the disclosure. FIG. 5 is a schematic diagram illustrating the antenna module 120 in FIG. 4. As shown in FIG. 4 and FIG. 5, the antenna module 120 includes a waterproof protective cover 122, a transparent cap 123, a printed circuit board 124, a wireless communication unit 125, an antenna unit 126 and a light-emitting unit 127. As shown in FIG. 3, FIG. 4 and FIG. 5, the waterproof protective cover 122 is removably assembled on the opening 103 of the metal shielding case 102. In this embodiment, the waterproof protective cover 122 has a whorl 122*c*. By utilizing the whorl 122*c*, the waterproof protective cover 122 can be locked on the metal shielding case 102. However, the disclosure is not limited to lock the waterproof protective cover 122 onto the metal shielding case 102 with the whorl 122*c*. In another embodiment, the waterproof protective cover 122 can be fixed onto the metal shielding case 102 through a limit portion, a fastening portion, a clamping portion or any equivalent connection mean.

Furthermore, the antenna module 120 may include a sealing ring 128. The sealing ring 128 is hold between the waterproof protective cover 122 and the metal shielding case 102 when the waterproof protective cover 122 is assembled on the opening 103 of the metal shielding case 102. To be specific, when the waterproof protective cover 122 is assembled onto the metal shielding case 102, the sealing ring 128 is utilized to seal the gap between the waterproof protective cover 122 and the metal shielding case 102 and ensure that no water or dust may go through the opening 103 into the internal space of the metal shielding case 102.

The water-proof protective cover 122 has a housing slot 122*a* and four sockets 122*b*. The transparent cap 123 is mounted on the waterproof protective cover 122. In this case, the transparent cap 123 includes a light-guiding cap and at least one light-guiding plug (i.e., four light-guiding plugs 123*a* shown in FIG. 4). In this embodiment, the light-guiding cap and the light-guiding plugs 123*a* of the transparent cap 123 are formed in one piece and made of a light-guiding material. These light-guiding plugs 123*a* are inserted into the sockets 122*b* of the waterproof protective cover 122. The light-guiding plugs 123*a* are configured for holding the transparent cap 123 and bypassing an indicative light generated by the light-emitting unit 128.

A first part 124*a* of the printed circuit board 124 is inserted into the housing slot 122*a* of the waterproof protective cover 122. The antenna unit 126 is disposed on the first part 124*a* of the printed circuit board 124, such that the antenna unit 126 can be located outside the shielding space formed by the metal shielding case 102. Therefore, the antenna unit 126 may transmit/receive wireless communication signal without being blocked by the metal shielding case 102.

On the other hand, a second part 124*b* of the printed circuit 124 is located within the shielding space formed by the metal shielding case 102. The wireless communication unit 125 is disposed on the second part 124*b* of the printed circuit board 124.

The wireless communication unit 125 is electrically connected to the mainboard (and indirectly connected to the electronic circuit 106 on the mainboard 104 shown in FIG. 2) of the electronic system. The wireless communication unit 125 is configured to perform a communication (e.g., sending/receiving/exchanging the controlling signals or information on the electronic system) with other systems or devices (not shown in figures) remotely through the antenna unit 126. The antenna unit 126 electrically connected with the wireless communication unit 125.

The light-emitting unit 127 is configured for generating the indicative light representing a system condition (e.g., operating, suspended, error, etc) of the electronic system 100. For example, the indicative light may turn green or red for representing different system conditions; or the indicative light may be lighten still or blink for representing different system conditions. The indicative light generated by the light-emitting unit 127 may project through the transparent cap 123, such that a system maintainer may monitor the system condition easily by checking the indicative light. The light-emitting unit 127 can be disposed near the transparent cap 123, such that the indicative light may projects outside easily. In the embodiment, the light-emitting unit 127 is disposed on the first part 124*a* of the printed circuit board 124. However, the disclosure is not limited thereto. In another embodiment, the light-emitting unit can be disposed on another location on the printed circuit board 124.

Based on aforesaid embodiments, the disclosure provides an antenna module and an electronic system, which include a waterproof protective cover, which is removably assembled on an opening of the metal shielding case of the electronic system. An antenna unit can be disposed within a housing slot of the waterproof protective cover located outside the metal shielding case, such that signal strength of the antenna unit may not be reduced by the metal shielding case. The waterproof protective cover can be locked on the metal shielding case to achieve the waterproof feature. In addition, the antenna module includes a transparent cap mounted on the waterproof protective cover, such that the indicative light may go through the transparent cap without violating the waterproof feature.

As is understood by a person skilled in the art, the foregoing embodiments of the present disclosure are illustrative of the present disclosure rather than limiting of the present disclosure. It is intended to cover various modifications and similar arrangements included within the spirit and scope of the appended claims, the scope of which should be accorded with the broadest interpretation so as to encompass all such modifications and similar structures.

What is claimed is:

1. An antenna module, suitable for an electronic system, the electronic system comprising a metal shielding case, the antenna module comprising:

s a waterproof protective cover removably assembled on an opening of the metal shielding case, the water-proof protective cover having a housing slot;

a transparent cap mounted on the waterproof protective cover;

a printed circuit board, a first part of the printed circuit board being inserted into the housing slot, a second part of the printed circuit being located within the metal shielding case;

a wireless communication unit disposed on the second part of the printed circuit board; and an antenna unit disposed on the first part of the printed circuit board and electrically connected with the wireless communication unit.

2. The antenna module as claimed in claim 1, further comprising a sealing ring, wherein the sealing ring is hold between the waterproof protective cover and the metal shielding case when the waterproof protective cover is assembled on the opening of the metal shielding case.

3. The antenna module as claimed in claim 1, wherein the antenna module further comprises a light-emitting unit configured for generating an indicative light representing a system condition of the electronic system, and the indicative light is projected through the transparent cap.

4. The antenna module as claimed in claim 3, wherein the light-emitting unit disposed on the first part of the printed circuit board.

5. The antenna module as claimed in claim 3, wherein the transparent cap comprises a light-guiding cap and at least one light-guiding plugs, and the light-guiding plugs is inserted into the waterproof protective cover for holding the transparent cap and bypassing the indicative light.

6. The antenna module as claimed in claim 1, wherein the wireless communication unit is electrically connected to a mainboard of the electronic system.

7. An electronic system, comprising:

a metal shielding case;

a mainboard disposed within the metal shielding case;

an electronic circuit disposed on the mainboard;

an antenna module, a part of the antenna module being exposed outside the metal shielding case, the antenna module comprising:

a waterproof protective cover removably assembled on an opening of the metal shielding case, the waterproof protective cover having a housing slot;

a transparent cap mounted on the waterproof protective cover;

a printed circuit board, a first part of the printed circuit board being inserted into the housing slot, a second part of the printed circuit being located within the metal shielding case;

a wireless communication unit disposed on the second part of the printed circuit board, the wireless communication unit being electrically connected to the mainboard of the electronic system; and an antenna unit disposed on the first part of the printed circuit board and electrically connected with the wireless communication unit, the antenna unit being located outside a shielding space formed by the metal shielding case.

8. The electronic system as claimed in claim 7, wherein the antenna module further comprises a sealing ring, and the sealing ring is hold between the waterproof protective cover and the metal shielding case when the waterproof protective cover is assembled on the opening of the metal shielding case.

9. The electronic system as claimed in claim 7, wherein the antenna module further comprises a light-emitting unit disposed on the first part of the printed circuit board.

10. The electronic system as claimed in claim 9, wherein the light-emitting unit is configured for generating an indicative light representing a system condition of the electronic system, the indicative light is projected through the transparent cap.

11. The electronic system as claimed in claim 9, wherein the transparent cap comprises a light-guiding portion, and the light-guiding portion is inserted into the waterproof protective cover for holding the transparent cap and bypassing the indicative light.

12. The electronic system as claimed in claim 9, wherein the electronic system is installed outdoors.

* * * * *